US005924605A

United States Patent [19]

Baudin et al.

[11] Patent Number: 5,924,605

[45] Date of Patent: Jul. 20, 1999

[54] DISPENSING HEAD FOR A PRODUCT OF LIQUID TO VISCOUS CONSISTENCY, COMPRISING AN ELASTIC CLOSING ELEMENT AND A DISPENSING UNIT THUS EQUIPPED

[75] Inventors: Gilles Baudin, Domont; Nicolas Albisetti, Clichy, both of France

[73] Assignee: L'Oreal, Paris, France

[21] Appl. No.: 08/886,459

[22] Filed: Jul. 1, 1997

[30] Foreign Application Priority Data

Mar. 7, 1996 [FR] France ..... 96 08279

[51] Int. Cl.[6] ..... B65D 5/72

[52] U.S. Cl. ..... 222/494; 222/212; 222/213; 222/491; 222/541.4; 222/544

[58] Field of Search ..... 222/107, 212, 222/213, 491, 492, 493, 494, 541.1, 541.2, 541.3, 541.4, 541.5, 544

[56] References Cited

U.S. PATENT DOCUMENTS

| | | | |
|---|---|---|---|
| 2,061,124 | 11/1936 | Walther | 221/60 |
| 2,122,299 | 6/1938 | Sloan | 222/153 |
| 2,173,627 | 9/1939 | Jecusco | 221/61 |
| 4,561,570 | 12/1985 | Zulauf et al. | 221/60 |
| 5,071,017 | 12/1991 | Stull | 222/491 |
| 5,632,420 | 5/1997 | Lohrman et al. | 222/494 |

FOREIGN PATENT DOCUMENTS

| | | |
|---|---|---|
| 0 111 798 | 6/1984 | European Pat. Off. . |
| 0 442 379 | 8/1991 | European Pat. Off. . |
| 0 495 440 | 7/1992 | European Pat. Off. . |
| 295 08 151 U | 9/1995 | Germany . |
| 1 046 518 | 10/1966 | United Kingdom . |

*Primary Examiner*—David J. Walczak
*Assistant Examiner*—Timothy L. Maust
*Attorney, Agent, or Firm*—Young & Thompson

[57] ABSTRACT

A dispensing head for the dispensing a product of a liquid to viscous consistency from a container includes a rigid cap (2) and an elastic closing element (4) joined to the cap (2), and a zone of smaller thickness delimited by the edges of a groove (6) made in the elastic element. The zone of a smaller thickness ruptures under the effect of a pressure exerted on one side or the other of the elastic element (4) to define at least one slit (5) capable of opening under the thrust of the product with a view to its dispensing, and returning to its contiguous position when this thrust ceases to be applied. The rupture may occur during manufacture to form the slit or may be caused by a user squeezing the container prior to first use of the product.

15 Claims, 4 Drawing Sheets

DISPENSING HEAD FOR A PRODUCT OF LIQUID TO VISCOUS CONSISTENCY, COMPRISING AN ELASTIC CLOSING ELEMENT AND A DISPENSING UNIT THUS EQUIPPED

BACKGROUND OF THE INVENTION

The invention relates to a dispensing head for a product of a liquid to viscous consistency, comprising a rigid cap and an elastic closing element provided with at least one closed dispensing slit, capable of opening under the thrust of the product and of returning to its initial position when this thrust ceases to be applied. The invention also relates to a dispensing unit for the product fitted with this dispensing head, as well as to a method for manufacturing the dispensing head.

The aim of the invention is in particular to provide a dispensing unit of the kind having a semi-rigid or flexible reservoir fitted with a rigid, or semi-rigid dispensing head provided with an elastically deformable dispensing opening.

The dispensing unit of the invention is intended more particularly to equip a compressible reservoir containing the product, and to permit its dispensing in good, clean conditions. This product may, in particular, be a cosmetic, dermatological or food product, such, for example, as shampoo, a hair gel, a shower foam gel, liquid soap, a face cream, a body lotion, liquid make-up or a household product or an adhesive.

From GB-A-1 476 620 there is known a tube, for a liquid product, which is fitted with a dispensing head. This dispensing head has a rigid cap provided with an outlet opening for the product in the form of an attached elastic membrane into which a slit is cut by mechanical cutting. A fixing ring holds the membrane in position on the dispensing head. When the user exerts pressure on the tube, the edges of the slit diverge under the thrust of the product and close again when the pressure of the product stops. The edges of the slit are contiguous, which renders superfluous the closing of the outlet opening by a stopper.

However, this tube has drawbacks from the point of view of its manufacture. Indeed, the assembly of the head consisting of two or three separate pieces (a cap, membrane, fixing ring for the membrane) requires recourse to a special assembly machine, which increases the manufacturing cost. Moreover, obtaining the slit is effected in particular by cutting, requiring the take-up of the membrane in another machine, which considerably increases still further the cost price of the dispensing head of the prior art.

Moreover, there is known, from EP-A-0 545 678 and U.S. Pat. No. 5,339,995, a dispensing head comprising a slit circular membrane provided with a peripheral fixing sleeve folded into a U-shape. As in the embodiment according to GB-A-1 476 620 mentioned above, the edges of the slit are obtained by the mechanical cutting of the slit. Therefore, this dispensing head is onerous and disadvantageous from an economic point of view. For this reason it is not suitable, in particular for a widely distributed product, such as a shampoo or a dishwashing product, for which the price must be moderate.

Moreover, EP-A-O 111 798 describes a dispensing head comprising a rigid cap and an elastic closing and dispensing element joined to the cap. According to this prior art, the elastic closing element has a slit formed by two parallel lips disposed in particular to project on the outer side of the elastic element, so that a recess is formed on the inner side of the element, in a zone in the proximity of the edges of the lips.

SUMMARY OF THE INVENTION

The object of the present invention is to provide a dispensing unit that is simple to make and at an extremely advantageous cost.

The Applicant has discovered that it was possible, in one and the same machine, on the one hand to obtain the injection moulding of the cap and of the elastic element, and on the other hand to obtain a slit with contiguous edges in the elastic element. Indeed, according to the invention, the dispensing slit of the elastic element is not obtained by mechanical cutting, but by tearing a zone of smaller thickness by means of a suitable tool, for example, mechanically or pneumatically. This tearing action may, in particular, be a pressure exerted on one side or the other of the elastic element on the zone of smaller thickness. In particular, by making the slit of the elastic element by tearing, the Applicant has found that it was possible to reduce the cost of manufacture of a dispensing head by a quarter, or even a third, as compared with the cost of manufacture of a conventional dispensing head which has a membrane with a slit obtained by mechanical cutting.

Thus the present invention relates to a dispensing head for a product of a liquid-to-viscous consistency, comprising a rigid or semi-rigid cap and an elastic closing element joined to the cap. In accordance with the invention, the dispensing head is characterized in that a zone of a smaller thickness is delimited by the edges of a groove made in the elastic element, the zone of smaller thickness being capable of rupturing under the effect of a pressure exerted on one side or the other of the elastic element, so as to define at least one contiguous slit capable of opening under the thrust of the product with a view to its dispensing, and returning to its contiguous position when this thrust ceases to be applied.

Advantageously, the elastic closing element takes the form of a membrane with a greater, or smaller thickness, disposed at the end of a feeder duct arranged in the cap and communicating with a reservoir containing the product to be dispensed.

Generally, the cap is formed of a rigid or semi-rigid thermoplastic material, for example of polyethylene or polypropylene. This cap is fixed, for example by screwing or catch-engagement, on the reservoir for the product to be dispensed. Advantageously, this bottle is semi-rigid or flexible, provided with compressible walls, so that pressure on the walls of the bottle starts the dispensing of the product. Advantageously, the cap is provided with a dispensing duct closed by the elastic element.

According to a worthwhile aspect of the invention, the slit is obtained by the tearing of the membrane. Indeed, the groove forming a preweakened zone, for example in the form of a film, may be opened by a tearing action, either mechanically by means of an appropriate tool, or pneumatically by means of a compressed air jet. In order to delimit the slit over a precise length, the slit may be surrounded continuously or discontinuously with a reinforcing bead or fillet. The tearing of the zone of smaller thickness may be effected in particular either on the inner side or the outer side of the membrane.

The slit thus obtained constitutes a dispensing opening that is substantially leakproof to any inopportune outflow of the product. The edges of this slit diverge from one another when the user exerts pressure on the bottle turned upside down to produce the dispensing of a dose of the product. Thanks to the elasticity of the membrane, the slit reassumes its original shape when the pressure on the bottle stops, and the outflow of the product is stopped in a clearcut manner.

Generally, this elastic element is a membrane made of a second elastomeric material, and more particularly, of a thermoplastic elastomer. More precisely, this membrane is formed by a flexible material, having a shape memory capable of reassuming its initial shape after deformation. Advantageously, this material is chosen in such a way that the membrane can be moulded in a single part with the cap, by duplicate injection moulding of the first and second materials. For this purpose, an elastomer physically and chemically compatible with the first material of the cap is chosen and which is capable of forming with it a solid bond by thermofusion. Typically, the membrane is constituted, for example by mixtures of polypropylene and of block copolymers of styrene-butadiene-styrene, of polypropylene and block copolymers of styrene-ethylene-butylene-styrene, of polypropylene and of block copolymers of ethylene-propylene-diene.

In general, the membrane takes the form of a circular disk of a variable thickness. It is, however, possible to make it in any other desirable shape, for example an oval shape. The surface of this disk may be flat, but this surface is advantageously curved, being for example, concave or convex. More particularly, a convex membrane is preferred whose convexity is turned towards the side whereon the thrust of the product is exerted.

The slit obtained in the membrane preferably passes through the center of the disk. In accordance with the invention, this slit is situated at the bottom of a groove arranged in the membrane. This groove, straight or curved, advantageously has a V-shaped or U-shaped cross-section. It may be obtained in several arms. Two or several grooves may be made. These grooves may be parallel or crossed.

According to a preferred form of the invention, the membrane has two crossed grooves forming a right angle between them. The depth of this groove advantageously represents 30% to 90% of the total thickness of the membrane. Advantageously, the total thickness of the membrane is situated between 0.5 mm and 3 mm. Such a groove typically has a length of approximately 0.5 cm to 2.5 cm. Advantageously, the bottom of the groove is formed by a groove of smaller thickness, in the form of a film with a thickness of approximately 0.1 mm to 1 mm.

The cap may, moreover, comprise a folding lid capable of being placed on the elastic element and intended to ensure the protection of the membrane during storage of the product. Advantageously, this lid is hinged to the cap, preferably by means of a film hinge. This permits the integral moulding in a single part of the dispensing head (cap-hinge-lid-membrane with the slit). The inner side of the lid may comprise one, or several sealing means, capable of coming to bear on the elastic element. Thus its inner side may comprise an annular bead capable of surrounding the slit and being applied in a leakproof manner against the membrane.

A dispensing unit provided with a reservoir for the product and comprising the dispensing head in accordance with the invention may be used in particular for dispensing a product of a liquid to viscous consistency. The viscosity of this product is typically situated in the range extending from 0.8 Pa·s to 10 Pa·s, and more particularly in the range extending from 1.2 Pa·s to 8 Pa·s. Advantageously, the product takes the form of a gel.

The use of the dispensing head of the invention is easy, since moderate pressure on the reservoir is sufficient for starting dispensing of the product.

After the dispensing of the product, the flow of the product can be cut in a clearcut manner, without producing any run-off. Thus the dosing of the product may be effected by the user in a smooth and precise manner.

Yet another object of the invention is constituted by a method for manufacturing the cap. This method lies in successively effecting the following steps:

- injection moulding in an appropriate mould a rigid cap comprising a hinged lid made of a first rigid or semi-rigid material;
- overmoulding by injection an elastic closing element made of a second elastomeric thermoplastic material, while making a groove whose edges delimit a zone of smaller thickness; and
- causing the rupture of a zone of smaller thickness by means of a pressure exerted on one side or the other of the elastic element, so as to form at least one slit with contiguous edges.

The pressure may be of a mechanical nature, for instance by means of a punch, or of a pneumatic nature, for example, by means of a highly pressurized jet of compressed air. The rupturing or tearing operation may be effected in the mould, or after the dispensing head has been taken out of the mould, or during the first use of the dispensing unit. This last solution is particularly advantageous in that it allows the product to be preserved in a leakproof manner before its first use. The tearing is effected under the simple pressure of the product when the user presses on the deformable walls of the reservoir.

According to a worthwhile aspect of the invention, the tearing punch may be carried by the lid, so that the slit is obtained when the lid is being closed. In this case, a lid may be provided with a punch immobilized by a wedge in a half-open position. During the first use, the wedge is withdrawn and the lid is folded down into the closed position. With this operation, the user himself undertakes the opening of the slit. He thus has available a guarantee that the product has not been used. Thanks to the invention, this guarantee may be obtained in an extremely simple and economic way.

BRIEF DESCRIPTION OF THE DRAWINGS

To render the present invention more readily understood, several embodiments of a head and dispensing unit in accordance with the invention will now be described by way of purely illustrative and non-restrictive examples, represented in the attached drawings, in which.

DESCRIPTION OF THE PREFERRED EMBODIMENT

Figure 1:
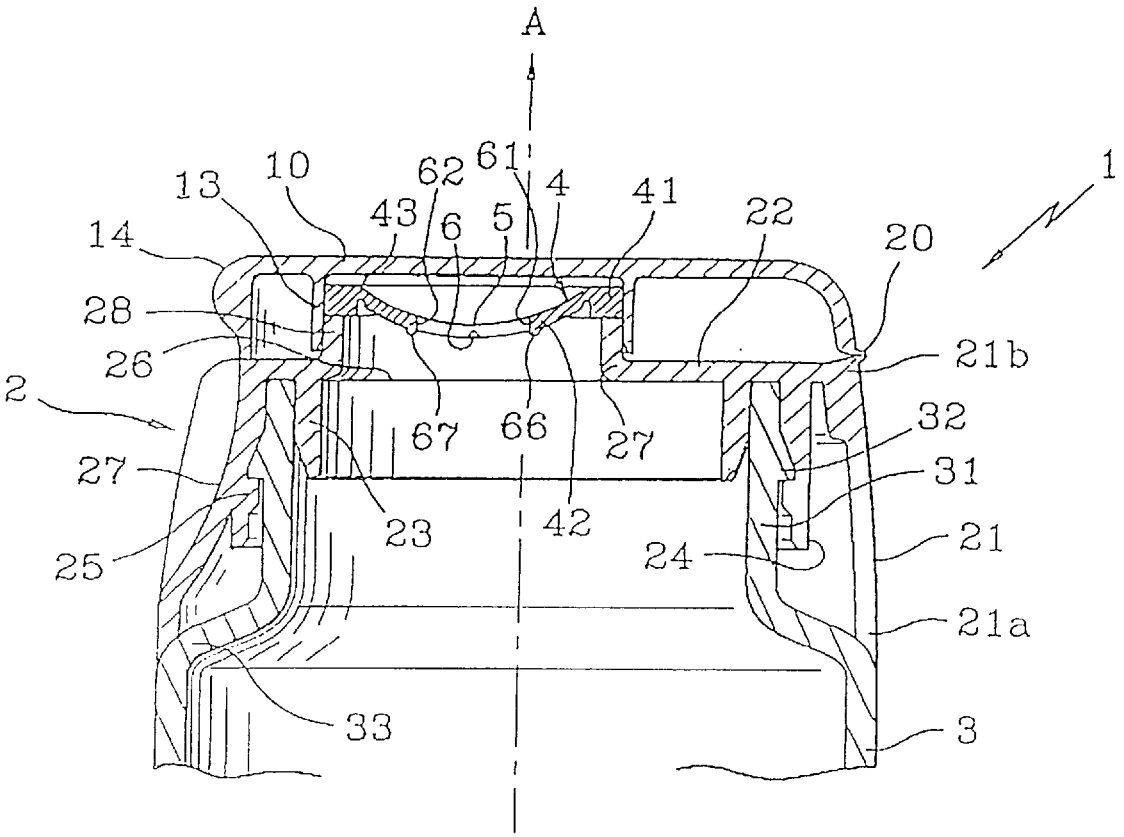
FIG. 1 shows a partial axial section of the dispensing unit according to a first embodiment of the invention, in the storage position.
Figure 2:
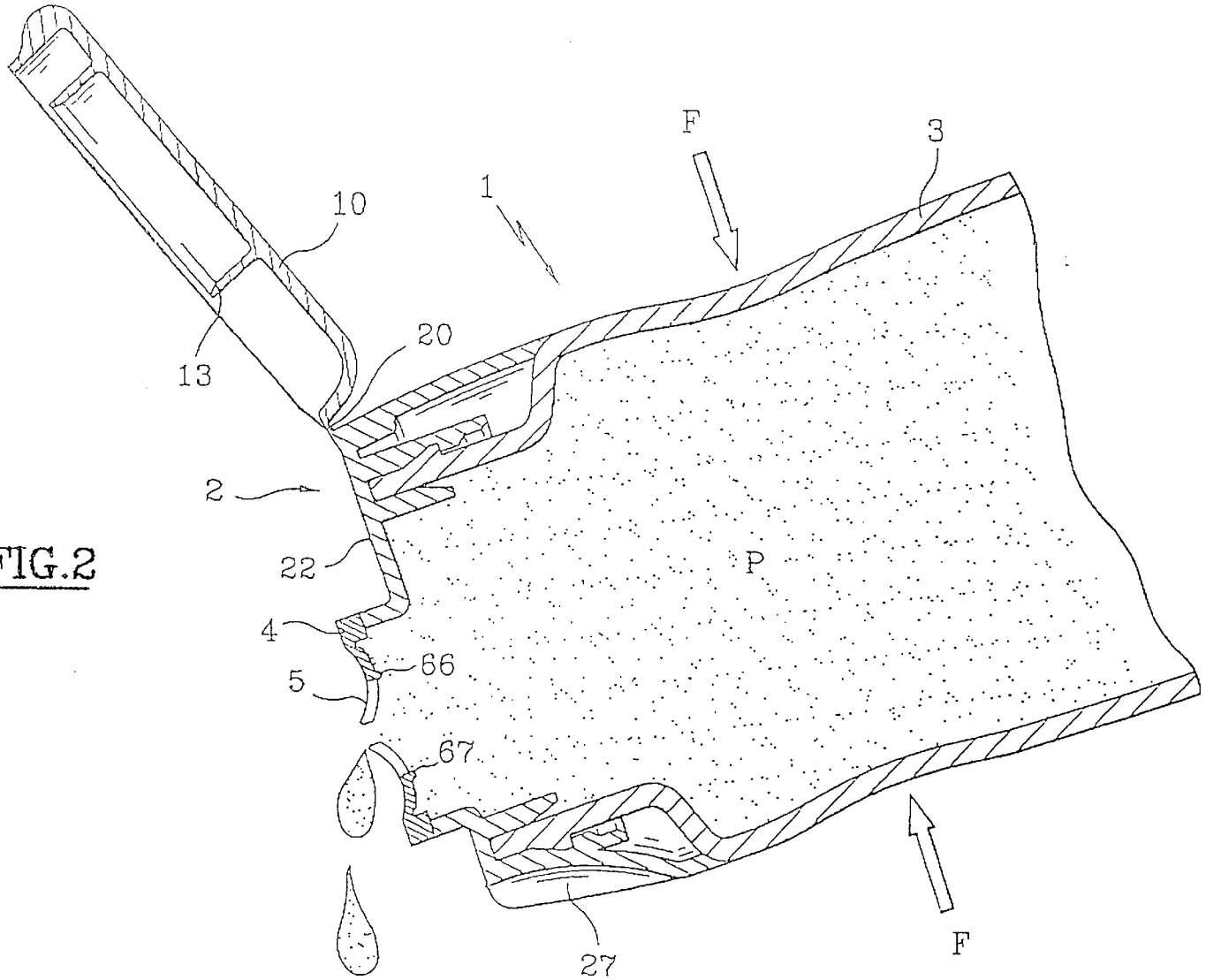
FIG. 2 shows a partial axial section of the unit of FIG. 1 in its position of use.
Figure 3:
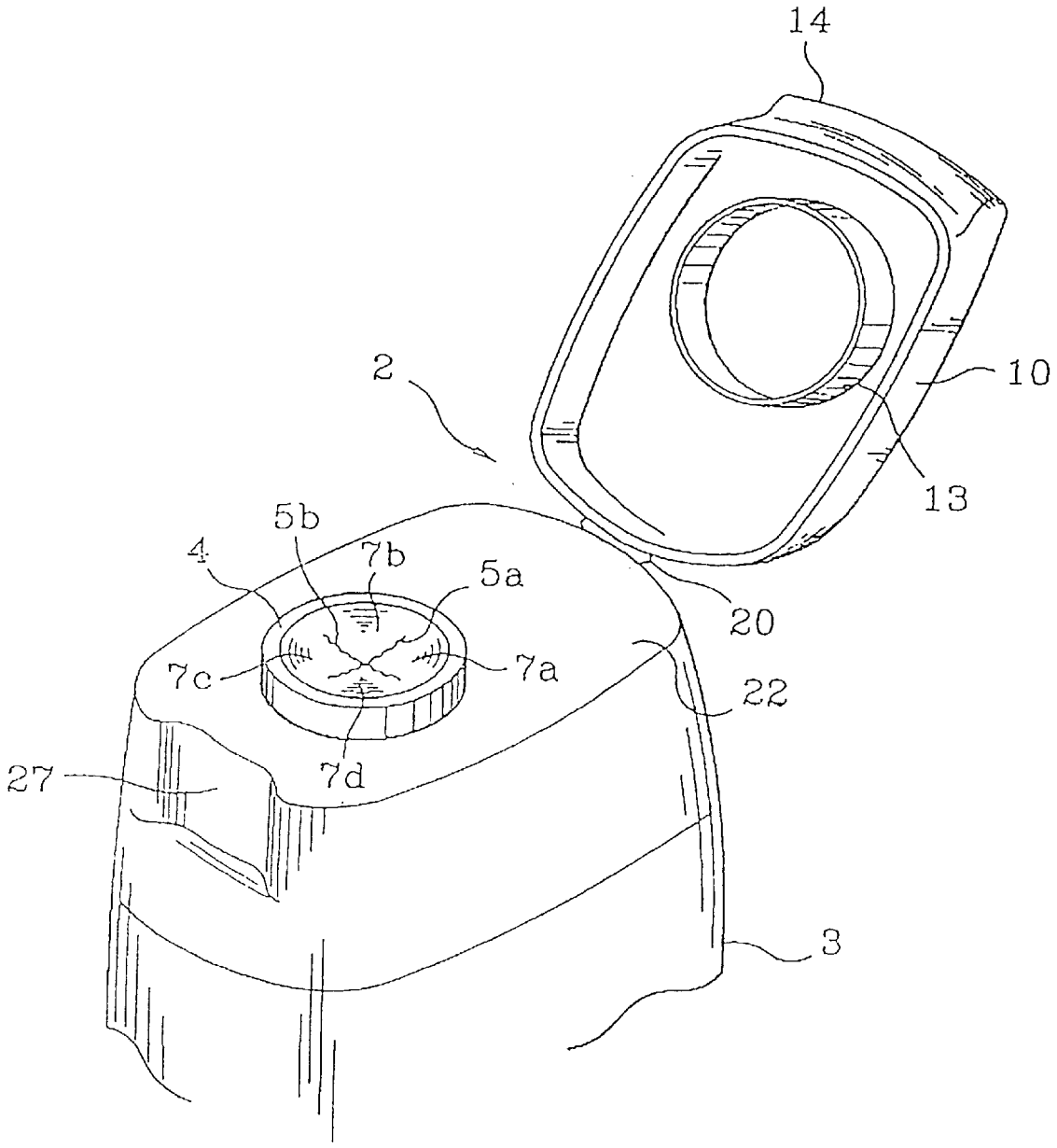
FIG. 3 shows a unit of FIG. 1 in perspective, the lid being in its open position.

Referring to these drawings, in particular to FIGS. 1 to 3, the upper part of a container 3 may be seen, which forms a reservoir for a product P, such as a shampoo having, for example, a viscosity of 3 Pa·s. This container has an oval cross-section and is provided with an axis of symmetry A. It is compressible and is formed, for example, by a thermoplastic material such as polyethylene. This container is provided with an open neck 31 of a cylindrical shape, provided with a catch-engagement bead 32. A transition zone between the neck and the container is formed by a shoulder 33.

On this container, there is fixed by catch-engagement, a dispensing cap 2 provided with a protective folding lid 10 and with an elastic closing and dispensing element provided with a slit 5.

The cap 2 has a body 21 of a generally cylindrical or oval shape, provided, on the side turned towards the container, with a lower end 21*a* and on the opposite side, with an upper end 21*b*.

The lower end 21*a* of the body 21 rests on the shoulder 33 of the container.

The upper end 21*b* of the body 21 is joined to a plate 22 of the same general shape as the body of the cap. On the side turned towards the cap, this plate has a first cylindrical skirt 23, capable of being engaged with friction inside the neck 31. A second cylindrical skirt 24 concentric with the first and having a larger dimension than the first skirt, surrounds the outside of the neck in a leakproof manner. This second skirt 24 has an annular rib 25 capable of cooperating with the bead 32 of the neck.

The plate 22 is provided with a circular dispensing opening 26 which is eccentric in relation to the axis A. The edge 27 of this opening 26 is extended in a cylindrical tube 28 which carries the elastic element 4.

Advantageously, the material constituting the cap is a relatively rigid thermoplastic material, for example, polypropylene.

The elastic element 4 has the shape of a disk. This disk is provided with a peripheral bulge 41 and a dish-shaped central membrane 42 whose concavity is turned towards the inside of the cap. The peripheral bulge has a greater thickness than the central membrane 42. This elastic element is constituted by a thermoplastic elastomeric material, for example a mixture of polypropylene and of block copolymers of styrene-ethylene-butylene-styrene.

The peripheral bulge 41 of the disk is joined to the cylindrical tube 28 of the cap, the bonding being obtained during the moulding of the cap by the duplicate injection moulding of the elastomeric material which forms the elastic element, on the rigid material which forms the cap. In general, the two materials and the moulding conditions are chosen in such a way that a solid bond is formed by thermal fusion and/or mechanically, between the cap and the elastic element.

An annular transition zone 43 situated between the peripheral bulge 41 and the central membrane 42, is provided with an annular groove and has a smaller thickness, as compared with the rest of the membrane. With this arrangement, a particularly flexible membrane is obtained.

In the central membrane 42, two crossed slits 5*a*, 5*b* are made (see FIG. 3) with arms of equal length, which form a right angle between them. Each slit 5*a*, 5*b* is situated at the bottom of a groove 6 (see FIG. 1) made in the membrane on the side turned towards the container. This groove is V-shaped. The bottom of the groove forms a film with a thickness of approximately 0.2 mm. The thickness of the film is such that it can be broken by tearing by means of a pressurized air jet for example, or under the pressure of the product itself during its first use. After the film has been broken, the arms of the slit form four sectors 7*a–d* (FIG. 3) capable of bending towards the outside of the cap, as shown in FIG. 2, under the thrust of the product. For this purpose, the user holds the container in a position similar to that shown in FIG. 2, while exerting slight pressure on the container 3 for dispensing a dose of the product P. This pressure is indicated by the arrows F. The dispensing stops when the pressure on the container stops. When the container is held without pressure in this position, no outflow of the product is observed.

The cap 2 has, moreover, a concave circular arc-shaped recess 27 and on the opposite side to this recess, a film hinge 20 joined to the plate 22. The lid 10 is articulated by means of this hinge and is capable of preventing any inopportune outflow of the product P in the closed position, for example during carriage of the unit. A cylindrical skirt 13 is provided for being positioned in the closed position round the tube 28 in a leakproof manner, the circular circumference of the membrane coming into a close contact with the inner side of this skirt 13.

On the front side of the dispensing head, the lid 10 has, moreover, a projection 14 situated opposite the recess 29, as may be seen in FIG. 1. This projection, in combination with the recess 29, constitutes a gripping zone facilitating the opening of the lid.

Figure 4:
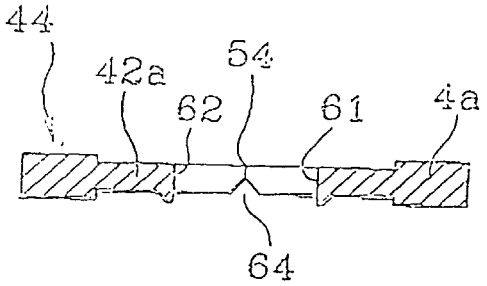
FIGS. 4 and 5 show a partial axial section of two variants of the embodiment of the elastic closing element.
Figure 5:
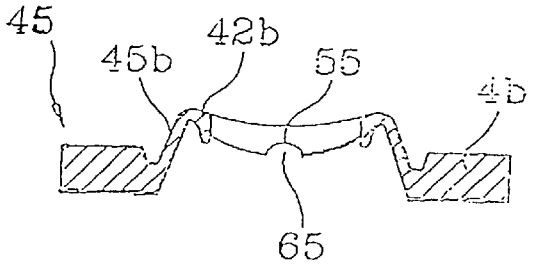

FIGS. 4 and 5 show two variants of the embodiment of the elastic element, bearing the reference numerals 44 and 45. To avoid any confusion, these membranes are represented individually. It will, of course, be understood that they are joined to the tube 28 of the cap.

FIG. 4 shows a variant of the elastic element 44 in a longitudinal section, which can be used for the dispensing of fluid products (having a viscosity of approximately 1 Pa·s). This element is provided with a peripheral bulge 4*a* with a slightly larger thickness than that of the central membrane 42*a*. The membrane is planar and is provided with two cross-shaped slits 54. Each slit is situated at the bottom of a V-shaped groove 64 and is obtained by tearing a zone of a smaller thickness in the form of a film, as indicated above.

FIG. 5 shows another variant of the elastic element 45 in a longitudinal section, which can be used for dispensing products of average viscosity (approximately 3 Pa·s). The element 45 is provided with a peripheral bulge 4*b* of a thickness distinctly higher than that of the rest of the central membrane 42*b*. The membrane is concave and provided with two cross-shaped slits 55. Each slit is situated at the bottom of a groove 65 with a "U"-shaped cross-section. A peripheral zone 45*b* of smaller thickness than the rest of the membrane 42*b*, is provided on each side of the membrane, imparting a suppleness in use during the dispensing of the product.

Figure 6:
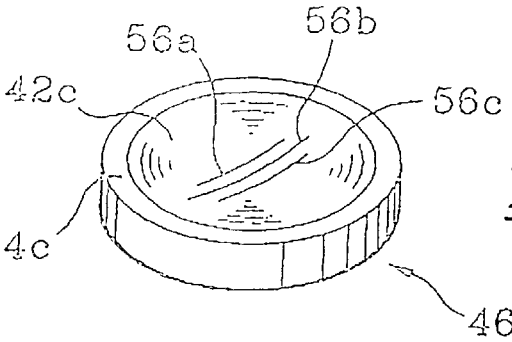
FIGS. 6 and 7 respectively show a view in elevation and an axial section of another variant of the embodiment of the elastic element.
Figure 7:
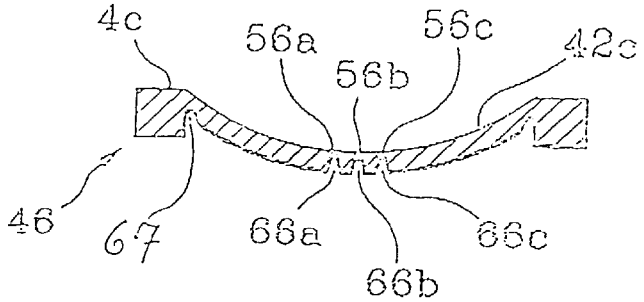

FIGS. 6 and 7 respectively show views in elevation and in an axial section of another variant of the elastic element 46. This element has a central membrane 42*c*of a concave shape. The inner side of this membrane has three parallel grooves 56*a*, 56*b*, 56*c* respectively provided with three slits 66*a*, 66*b*, 66*c*. An annular connecting zone 70 of a smaller thickness than that of the rest of the central membrane joins it to a peripheral bulge 4*c*. This zone 70 constitutes a bending zone ensuring a flexible deformation of the membrane 42 during the dispensing of the product.

The manufacture of the dispensing head is effected as follows. A rigid cap comprising an articulated lid made of a rigid or semi-rigid material is first injection moulded in an appropriate mould. In this same mould, the elastic closing element made of a second elastomeric thermoplastic material is subsequently overmoulded by injection, this element having at least one groove whose edges delimit a zone of a smaller thickness. In the mould, or after the removal of the head from the mould, the opening of the groove 6 is produced by tearing to obtain the slit 5. This opening may be effected by means of a mechanical tearing means, or pneumatically, for example, with compressed air. It is possible to arrange a mechanical tearing element (not shown) on the inner side of the lid, so that the opening of the slit is obtained during the closing of the lid.

To avoid excessive tearing of the membrane 4 during its opening by the tearing operation, a bead or fillet 66, 67 is advantageously provided at each end 61, 62 of the groove 6 (see FIG. 1). This bead (or fillet) may, if required, completely surround the groove in a continuous manner.

We claim:

1. A dispensing head for dispensing a product of liquid or viscous consistency from a container, said dispensing head comprising:

a rigid cap having an elastic closing and dispensing element which has a solid, unbroken exterior surface and an interior surface with a groove therein, the interior surface having a projecting bead located beyond longitudinal ends of said groove to resist longitudinal extension of said groove, said groove defining a zone of smaller thickness between the exterior surface and a deepest penetration of said groove, said zone of smaller thickness being arranged and constructed to rupture upon application of a predetermined pressure to one of the interior and exterior surfaces of said elastic closing and dispensing element to form a slit through said zone of smaller thickness for dispensing the product.

2. The dispensing head of claim 1, wherein said zone of smaller thickness is 10% to 70% of a thickness of said elastic closing and dispensing element.

3. The dispensing head of claim 1, wherein said zone of smaller thickness is 0.1 to 1 mm thick.

4. The dispensing head of claim 3, wherein said elastic closing and dispensing element comprises a thermoplastic elastomeric material and said zone of smaller thickness is 0.2 mm thick.

5. The dispensing head of claim 1, wherein said groove is one of U-shaped and V-shaped.

6. The dispensing head of claim 1, wherein the exterior surface of said elastic closing and dispensing element is concave.

7. The dispensing head of claim 1, wherein said bead surrounds said groove.

8. A dispenser for a product with a liquid or viscous consistency, comprising:

a compressible reservoir with one opening for dispensing the product in the reservoir;

a dispensing head for closing said opening, said dispensing head comprising an elastic closing and dispensing element which has a solid, unbroken exterior surface and an interior surface with a groove therein, the interior surface having a projecting bead located beyond longitudinal ends of said groove to resist longitudinal extension of said groove, said groove defining a zone of smaller thickness between the exterior surface and a deepest penetration of said groove, said zone of smaller thickness being arranged and constructed to rupture upon application of a predetermined pressure to one of the interior and exterior surfaces of said elastic closing and dispensing element to form a slit through said zone of smaller thickness for dispensing the product from said reservoir.

9. The dispenser of claim 8, wherein said elastic closing and dispensing element is 0.5 to 3 mm thick and said zone of smaller thickness is 10% to 70% of the thickness of said elastic closing and dispensing element.

10. The dispenser of claim 8, wherein said bead surrounds said groove.

11. A method of making a dispensing head for dispensing a product of liquid-to-viscous consistency from a container, the method comprising the steps of:

molding a rigid cap for the container;

overmolding onto the rigid cap an elastic closing and dispensing element which has a solid, unbroken exterior surface;

forming a groove in an interior surface of the elastic closing and dispensing element to define a zone of smaller thickness between the exterior surface and a deepest penetration of the groove;

projecting a bead from the interior surface beyond longitudinal ends of the groove to resist longitudinal extension of the groove; and applying pressure to one of the interior and exterior surfaces of the elastic closing and dispensing element to rupture the zone of smaller thickness to form a slit through the zone of smaller thickness for dispensing the product.

12. The method of claim 11, wherein said step of applying pressure comprises the step of applying pressure to the interior surface of the elastic closing and dispensing element.

13. The method of claim 12, wherein said step of applying pressure comprises the step of squeezing the container with the cap attached thereto to apply air pressure to the interior surface.

14. The method of claim 11, wherein said step of applying pressure comprises the step of applying pressure to the exterior surface of the elastic closing and dispensing element.

15. The method of claim 11, wherein the groove is one of U-shaped and V-shaped and wherein the groove is formed so that the zone of smaller thickness is 10% to 70% of a thickness of the elastic closing and dispensing element and is 0.1 to 1 mm thick.

* * * * *